US007427245B2

(12) United States Patent
Hickey

(10) Patent No.: US 7,427,245 B2
(45) **Date of Patent: *Sep. 23, 2008**

(54) ELECTRONIC RACQUET SCORE KEEPER AND VIBRATION DAMPER

(76) Inventor: Darren Bawden Hickey, 1775 Elsie Ave., Mountain View, CA (US) 94043

( * ) Notice: Subject to any disclaimer, the term of this patent is extended or adjusted under 35 U.S.C. 154(b) by 0 days.

This patent is subject to a terminal disclaimer.

(21) Appl. No.: 11/942,476

(22) Filed: Nov. 19, 2007

(65) Prior Publication Data

US 2008/0076609 A1 Mar. 27, 2008

Related U.S. Application Data

(63) Continuation of application No. 11/383,209, filed on May 14, 2006, now Pat. No. 7,300,366.

(51) Int. Cl.
*A63B 49/00* (2006.01)
*A63B 71/06* (2006.01)

(52) U.S. Cl. ..... 473/522; 473/553

(58) Field of Classification Search ..... 473/520–522, 473/553

See application file for complete search history.

(56) References Cited

U.S. PATENT DOCUMENTS

| | | | |
|---|---|---|---|
| 434,425 | A | 8/1890 | Cooper |
| 3,986,715 | A | 10/1976 | Glick |
| 4,165,710 | A | 8/1979 | Gaetano |
| 4,172,595 | A | 10/1979 | Sewell |
| 4,189,143 | A | 2/1980 | Van Auken et al. |
| 4,202,544 | A | 5/1980 | Popma |
| 4,331,098 | A | 5/1982 | Rubano |
| 4,498,668 | A | 2/1985 | Bowen |
| 4,557,215 | A | 12/1985 | Petersson |
| 4,589,662 | A | 5/1986 | Robaldo |
| 4,738,449 | A | 4/1988 | Droz |
| 4,927,143 | A | 5/1990 | Hillock |
| 5,022,651 | A | 6/1991 | Barone |
| 5,048,452 | A | 9/1991 | Haddock et al. |
| 5,134,565 | A | 7/1992 | Herbertz |
| 5,489,122 | A | 2/1996 | Pittner |
| 5,646,911 | A | 7/1997 | Davis |
| 5,879,249 | A | 3/1999 | Fox-Gurcay |
| 6,210,296 | B1 | 4/2001 | Gabriel |
| 6,270,434 | B1 | 8/2001 | Shaw |
| 6,527,655 | B2 | 3/2003 | Sims et al. |
| 7,300,366 | B1 * | 11/2007 | Hickey ..... 473/522 |
| 2002/0072438 | A1 | 6/2002 | Boxer |

* cited by examiner

*Primary Examiner*—Raleigh W. Chiu
(74) *Attorney, Agent, or Firm*—Hansen Huang Tech. Law Group

(57) ABSTRACT

A vibration damper for a racquet sport includes a score tallying device for keeping the score of t racquet sport such as tennis. The current score is maintained by an electronic circuit and displayed on an electronic display within the vibration damper. The vibration damper is configured to be attached to the racquet strings. The vibration damper and score keeper is preferably configured so that it displays only legitimate scores of the type of racquet sport for which it is intended.

20 Claims, 8 Drawing Sheets

Section A-A

ELECTRONIC RACQUET SCORE KEEPER AND VIBRATION DAMPER

RELATED APPLICATIONS

This application is a continuation of and claims the benefit of priority to U.S. patent application Ser. No. 11/383,209 filed May 14, 2006, which will issue as U.S. Pat. No. 7,300,366 on Nov. 27, 2007, the entire contents of which are hereby incorporated by reference.

FIELD OF THE INVENTION

This invention relates to the field of accessories for sports equipment, and more specifically to accessories for racquet sports such as tennis, racquetball, and squash.

BACKGROUND OF THE INVENTION

Tennis racquets can be equipped with small vibration absorbing masses which are attached to the strings of the racquet. The purpose of the vibration absorbing mass is to dampen or diminish the initial impulse and subsequent string and frame vibrations caused when a player's racquet strikes a tennis ball. Such masses are typically sold separately but may be installed on a new racquet or when a racquet is strung.

There are devices for attachment to the frame of a tennis racquet or to a player's wrist to help players tally the score for one or both players. Such devices have a number of disadvantages since scoring devices attached to the racquet change its weight and balance and many players prefer playing without anything on their wrists.

SUMMARY OF THE INVENTION

The present invention combines a vibration absorbing mass with an electronic score tallying device into a vibration damper/score keeper that attaches to the racquet strings to provide both vibration dampening and an easy way to track and display the game score. The present invention is suitable for use on racquets used in any racquet sport, including tennis, squash, racquetball, and badminton.

Each time the score in a game changes, the vibration damper/score keeper device can be manipulated by the finger or fingers of the player holding the racket to which the device is attached. Besides dampening vibrations, the device displays the current score. The vibration damper/score keeper is preferably designed so that it only displays legitimate scores of the type of sport for which it is used. Specifically for tennis, for example, the device would only display numeric scores of 0 (or "love"), 15, 30, and 40, and indications of "deuce" (e.g., "DU" or "40-40") and of "advantage" (e.g., "AD").

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

The various embodiments will be described in detail with reference to the accompanying figures. Generally, the same reference numbers will be used throughout the figures to refer to the same or like parts. The term "player" as used herein may also refer to two (or more) players on the same team.

Figure 1:
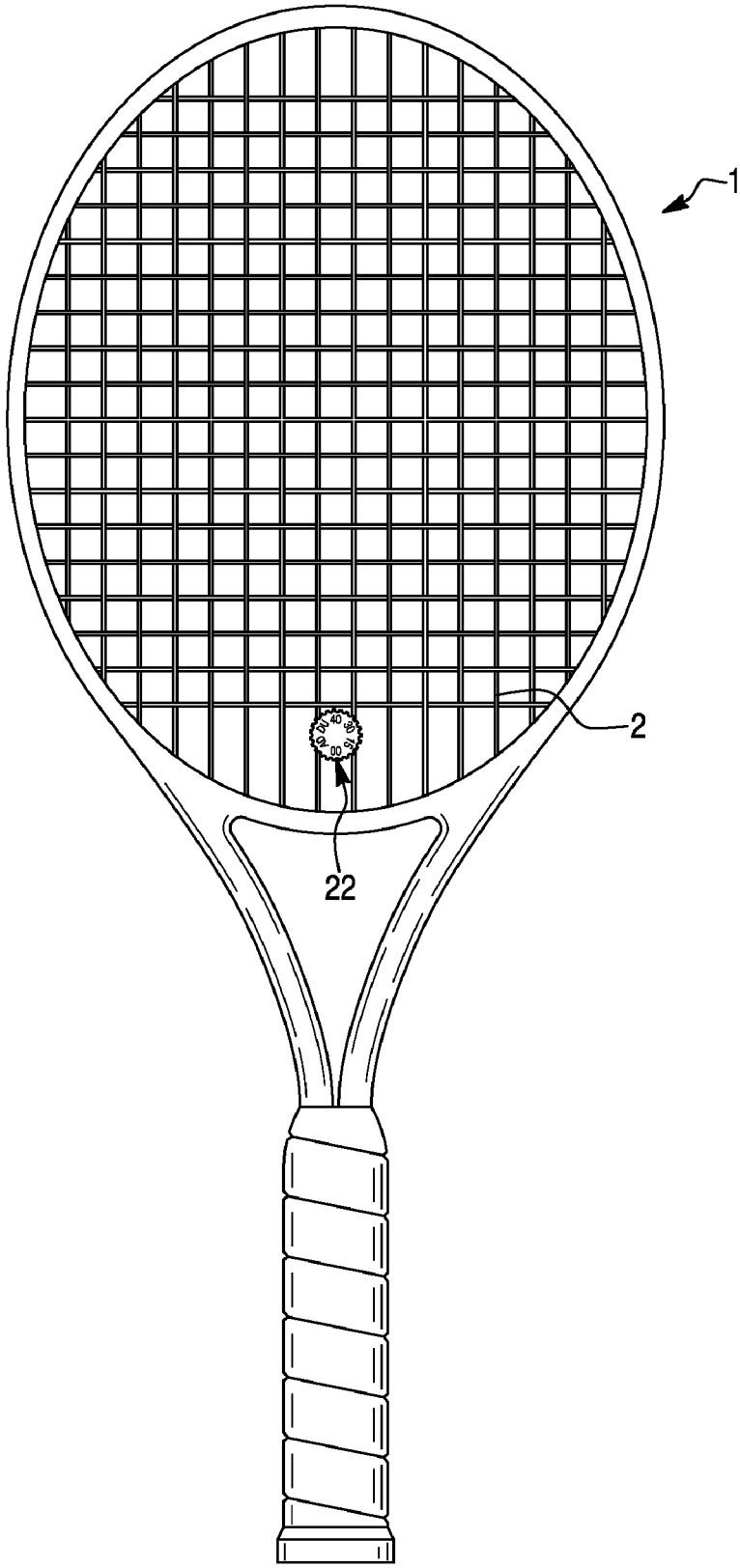
FIG. 1 is a perspective view of one embodiment of the invention installed on a tennis racquet.

FIG. 1 shows a vibration damper/score keeper 22 according to an embodiment of the present invention installed on a tennis racquet 1. While other locations are possible, the invention is illustrated as positioned on, near, or between the middle longitudinal strings 2 and on the handle-side of the transverse string closest to the handle portion of the racquet (i.e., "below" the bottom string). Official tennis rules permit vibration dampers (also referred to as vibration dampeners) to be attached to the racquet strings outside the pattern of the crossed strings, as illustrated in FIG. 1, for the purpose of dampening vibrations in the strings and racquet. See e.g., http://www.itftennis.com/technical/rules/equipment/racket.asp. Although the invention is frequently described herein as appropriate for use in tennis, the invention can more generally be adapted for and applied to any sport that utilizes a stringed racquet, such as squash, badminton and racquetball. Other racquet sport rules may permit locating vibration dampers in other locations on the racquet face. All locations on the strings of the racquet are within the scope of the present invention.

The vibration damper/score keeper of the various embodiments comprises sufficient mass, which can be of vibration absorbing material, to absorb a portion of the energy or impulse transmitted along the strings when the racquet strikes a ball (e.g., a tennis ball) during normal play. The vibration damper/score keeper can be made of one or more of a variety of shock absorbing materials, including by way of example but not by way of limitation, a plastic polymer, rubber, foam rubber, or a rubber-like material. Additionally, the vibration damper/score keeper may comprise a rubber or plastic outer shell encompassing a fluid (e.g., water or an oil) to provide hydrodynamic dampening. A pliant or plastic material will absorb energy of the initial impulse and subsequent string and racquet vibrations transmitted along the racquet strings. By presenting a mass on selected strings, vibration energy in the strings is absorbed in the acceleration of the vibration damper/score keeper, thereby leading to rapid dampening of vibrations in the racquet. Additionally, the harmonic frequency of strings attached to the mass is reduced, thereby reducing harmonic vibrations throughout the racquet. In some embodiments, vibration absorbent material may form a cage or housing for the score keeper.

Figure 4:
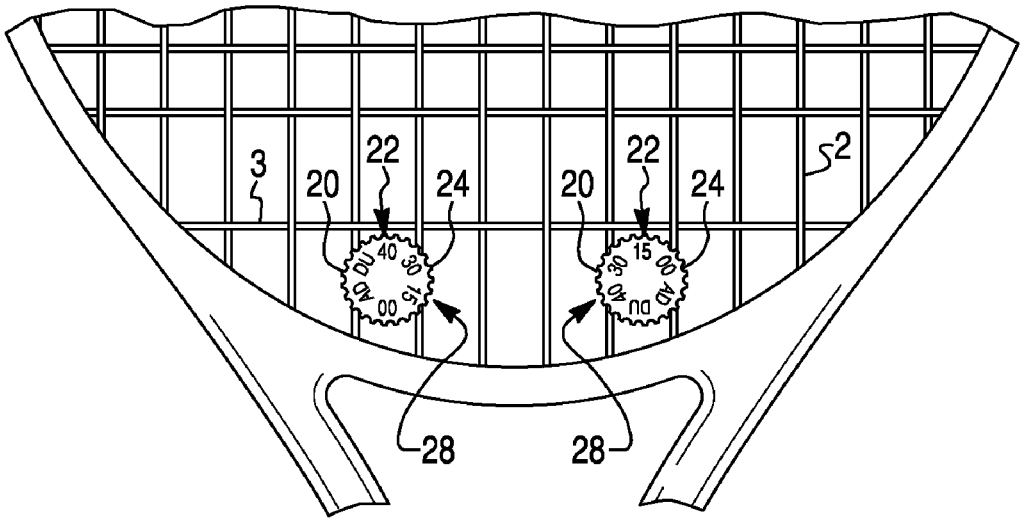
FIG. 4 is a perspective view of another embodiment.

FIG. 1 shows a single vibration damper/score keeper 22; however, multiple such devices may be used, such as two vibration damper/score keepers 22 as illustrated in FIG. 4, one for each side or player, or three vibration damper/score keeper 22, one for each side or player and one for a game or set tally.

Figure 2:
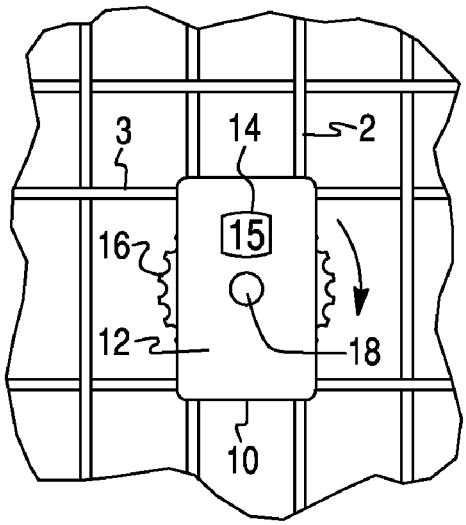
FIG. 2 is a perspective view of an embodiment.

FIG. 2 provides a close-up view of an embodiment of the vibration damper/score keeper 10, which shows only a few longitudinal strings 2 and transverse strings 3 of the racquet 1. In this embodiment, an outer body 12 encompasses a wheel indicator 16 and attaches to strings 2, 3, such as by means of a compression fitting. The outer body 12 may provide most of the mass required for impulse and vibration absorption and dampening. The score wheel indicator 16, which is illustrated separately in FIG. 3, includes all the possible game scores imprinted on it. An axis of rotation 18 on the outer body 12 and wheel indicator 16 allows the wheel indicator 16 to be rotated. The outer body 12 is configured so that a portion of the wheel indicator 16 extends beyond the exterior of the outer body 12 so that the wheel indicator 16 can be rotated by a player's finger. A window 14 in the outer body 12 is provided in a position and of a size so as to reveal a single score value on the wheel indicator 16 at a time. The outer body 12 is further configured to resist the free rotation of the wheel indicator 16, so that the wheel indicator 16 remains in a set position so the score displayed in the window 14 remains until the player applies sufficient rotational force to overcome the resistance to rotation. In use, a player simply rotates the wheel indicator 16, such as in the clockwise direction as shown in FIG. 2, until the appropriate score appears in the window 14. Then, with each successive point, the wheel indicator is turned one position to reveal the updated score.

In an embodiment, two wheel indicators 16 may be provided and attached to the racquet 1, one for each player. In a version of this embodiment, the outer body 12, the wheel indicator 16 and/or numbering may be of different colors to indicate the player to which vibration damper/score keeper 10 applies—such as black numbers on a white background for one player and white numbers on a black background for the other.

In another embodiment, two vibration damper/score keepers 10 are attached to the strings. In another embodiment, the outer body 12 includes two windows 14 and two wheel indicators 16, with one positioned on each side of two or four strings 2, 3. In this embodiment, each side will appear as illustrated in FIG. 2. In a version of this embodiment, the wheel indicators 16 and/or the printed scores on the two sides may be of different colors to indicate the player to which each side applies—such as black numbers on a white background on a side for one player and white on blue for the other.

Figure 3:
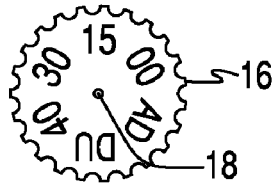
FIG. 3 is a detailed view of a portion of the embodiment shown in FIG. 2.

FIG. 3 shows a detail view of the wheel indicator 16 by itself, showing score numbering specifically intended for tennis. As is well known, tennis is scored 15, 30, 40, game, but if both sides or players reach 40, the game is scored "deuce" after which a side or player must score two points in succession to win. When a side or player wins a point after "deuce" that player is said to have the advantage, since winning another point will give that side or player the game. However, if the other side or player wins the next point, the score returns to "deuce." Accordingly, the "DU" and "AD" designations on the wheel indicator 16 respectively are abbreviations for "deuce" and "advantage", and the numbers represent possible scores for a tennis player. In another embodiment, the "DU" or deuce designation can be eliminated and represented by a score of "40-40." For embodiments appropriate for other racquet sports, such as racquetball, where there are a larger number of possible scores, for example 0 to 20, there will be a larger number of scores on the wheel indicator 16. Alternatively, two indicator wheels 16 may be provided per player-one for the units digits and one for the tens digits. Such a pair of indicator wheels 16 may be configured concentric and of differing radii, partly overlapping, spaced apart, or implemented as two separate instances of the two vibration damper/score keepers 10, with one for the 10's digit and one for the 1's digit of the score, for example.

Figure 5A:
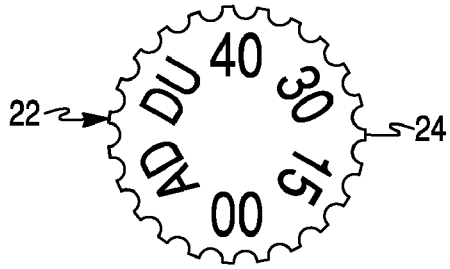
FIGS. 5A and 5B are orthogonal perspective views and FIG. 5C is a cross-sectional view of the embodiment shown in FIG. 4.
Figure 5B:
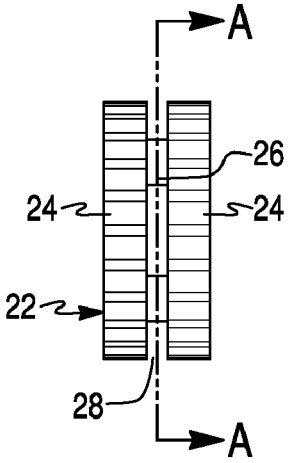
Figure 5C:
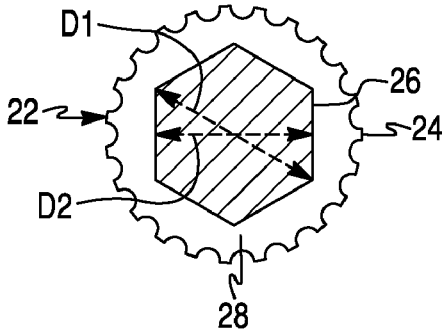

FIG. 4 illustrates another embodiment of the vibration damper/score keeper 22, close ups of which are shown in FIGS. 5A, 5B and 5C. In this embodiment, there is no outer housing and the vibration damper/score keeper 22 comprises a cylinder provided with a slot (or groove) 28 extending circumferentially around the cylinder, partially bisecting it into two generally planar portions (e.g., wheels) 24 connected by an interior hub 26. The axial length of each cylinder 22 should be long enough to allow easy rotation of the cylinder 22 by the thumb and index finger of the player holding the racquet. The diameter of the cylinder 22 should exceed the distance between two longitudinal strings 2, while the minimum diameter of the hub 26 should be less than the distance between two longitudinal strings 2. The slot 28 should be wide enough to accept a racquet string 2 on each side of the cylinder 22 as shown in FIG. 4. This allows each cylinder 22 to be captured by two adjacent strings 2. The vibration damper/score keeper 22 is attached to a racquet 1 by positioning it so a string 2 is within the groove 28 on either side of the hub 28. This may be accomplished by momentarily spreading apart the two strings 2 or, if the vibration damper/score keeper 22 is made from a pliable rubber, by bending the vibration damper/score keeper 22 to fit first one string and then another into the groove 28. A single damper/score keeper 22 may be used as illustrated in FIG. 1, such as one by each side or player to track their own scores. Alternatively, two (or more) vibration damper/score keepers 22 may be used on a single racquet as illustrated in FIG. 4, for tracking the scores of each side or player on the same racquet. As described above, two vibration damper/score keepers 30 may be made with different colors, such as white lettering on a black background on one and black lettering on a white background on the other, to indicate the player or side to which each score applies.

In an alternative of the embodiment of the vibration damper/score keeper 22 illustrated in FIG. 4, the width of the groove 28 is less than the diameter of a typical racquet string 2. In this embodiment, the planar portions 24 on either side of the groove 28 press against the strings 2 to provide sufficient friction to prevent the cylinder 22 from inadvertently turning.

In another alternative of the embodiment illustrated in FIG. 4, the innermost annular surface of the hub 26 is provided with a regular polygonal shape having an even number of sides equaling the number of different scores printed on one or both of the planar portions 24. An example polygonal shaped hub 26 is shown in a cross-sectional view in FIG. 5C. In this embodiment, the major diameter D1, which is the point-to-point diameter of the polygon, can be greater than the normal spacing between strings 2 while the minor diameter D2, which is, the face-to-face diameter of the polygon, of the hub 26 can be approximately equal to or less than the normal spacing between strings 2. In this configuration with score values printed on an edge portion of the planar portions 24 midway between flat sides, the tension of the strings 2 will snap the cylinder 22 to an orientation that shows a score at the 12 o'clock location as illustrated in FIG. 4. For example, for an embodiment appropriate for tennis illustrated in FIG. 4, which has six scores imprinted one or both of the planar portions 24, the hub 26 would be a six-sided polygon as shown in FIG. 5C. As another example, a hub 26 having a 10-sided polygonal shape will provide 10 preferred orientations when positioned between two strings, thereby providing a 10 digit scoring capability. While FIG. 5C shows the points of the polygon having sharp corners, the corners may be rounded or slightly flattened in order to permit easier rotation of the vibration damper/score keeper 22 from one score position to the next.

Scores can be imprinted on both sides of each cylinder 22. Additionally, the edges of the planar portions 24 may be serrated or grooved as illustrated in FIGS. 4, 5A and 5C to aid the player in rotating the planar portions 24 against the rotational resistance provided by the strings 2.

Figure 5D:
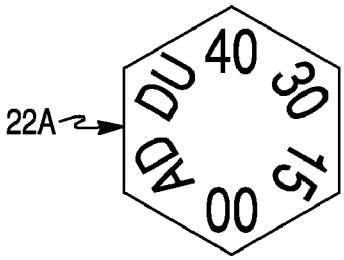
FIG. 5D is a perspective view of an alternative configuration of the embodiment shown in FIG. 4.

While the planar portion 24 of the vibration damper/score keeper 22 is shown in FIGS. 4, 5A, 5B and 5C as having a generally circular shape, these portions may have other shapes. For example, in an alternative configuration, the planar portion 24 may have a polygonal shape, such as with the number of sides matching the number of different scores in the game as illustrated in FIG. 5D for the case of a tennis score keeper. In this alternative, each score may be presented near a point (as shown in FIG. 5D) or near the midpoint of a flat side of the polygon. As another example, the planar portion 24 may have a star shape with the number of star points matching the number of different scores in the game and one score presented on each point. Additionally, the score values may be presented on the planar portions 24 with raised or lowered lettering, such as may be formed by an injection molding process, or printed on the surface (or a combination of both). Further, the surface or sides of the planar portions 24 may include a raised, lowered or edge shape that can be recognized by touch (like a brail pattern) so the player can determine and adjust the score by feel without having to look at the vibration damper/score keeper 22.

The embodiments illustrated in FIGS. 4, 5A, 5B, 5C and 5D can be manufactured as a unitary device by injection molding, or stamping from a sheet of rubber followed by simple machining (e.g., by a blade, hot wire or laser). When manufactured as a unitary device, the device is characterized by two planar portions coupled together by an internal hub portion as described above. The score numbering on the planar portions 22 may be formed by printing or as raised letters as part of an injection mold forming process. As such, the embodiment can be low cost to manufacture, having no parts to assemble or wear out.

Figure 6A:
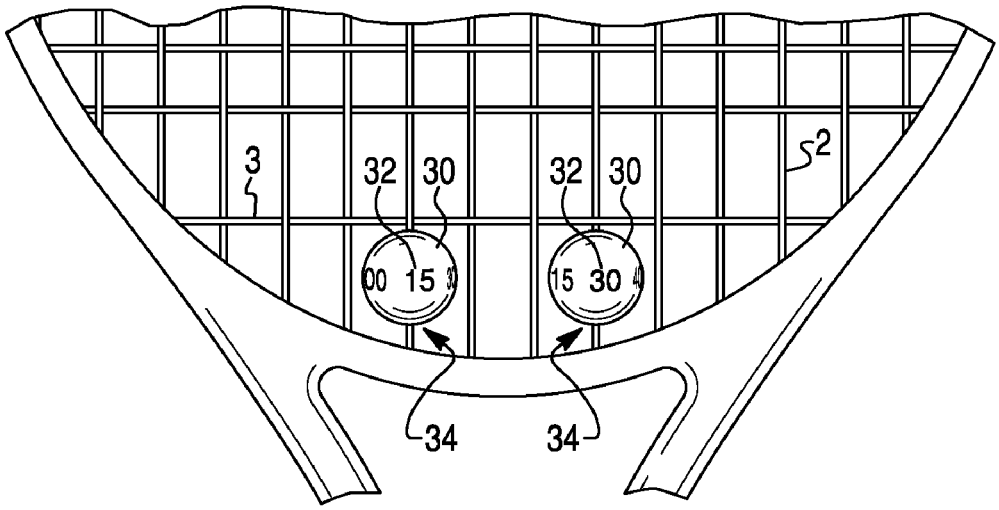
FIGS. 6A, 6B and 6C are perspective views of another embodiment.

FIG. 6A illustrates another embodiment in which the vibration damper/score keeper 30 is shaped as a sphere (illustrated), cylinder (not shown), or a frustum of a cone (not shown) on which are printed score values 32. In this embodiment, the vibration damper/score keeper 30 includes a channel 34 so that a string 2 passes through the center of the vibration damper/score keeper 30. The channel 34 can be a through-hole ("tunnel"), in which case the vibration damper/score keeper 30 can be installed when the racquet is strung. Alternatively, the channel can be in the form of a slot 35 (see FIGS. 6B and 6C) so the vibration damper/score keeper 30 can be fitted over a string 2, allowing the vibration damper/score keeper 30 to be installed without restringing.

Figure 6B:
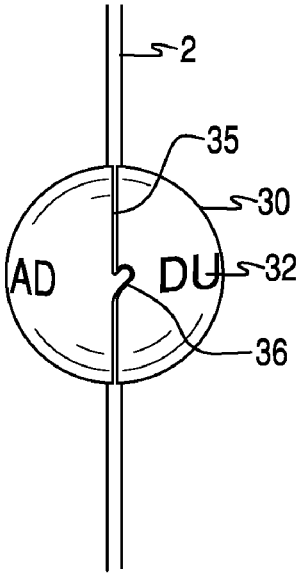

In an embodiment illustrated in FIG. 6B, the slot 35 can form or include an interlocking press fit joint 36, such as a snap joint, to allow the vibration damper/score keeper 30 to be clasped tightly over the string in order to prevent the vibration dampener/score keeper 30 from slipping off the string. Such a press fit joint may be an internal press fit joint on internal faces of the two hemispheres that snaps in place when the two hemispheres are pressed together. Alternatively, the slot 35 may be shaped so that a portion forms a press fit joint when the two hemispheres are pressed together, as illustrated in FIG. 6B.

Figure 6C:
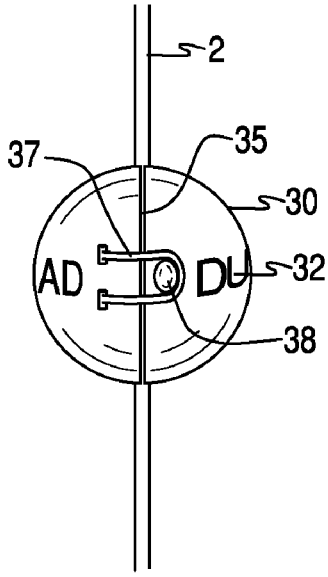

In an alternative embodiment illustrated in FIG. 6C, the slot 35 can be fitted with a clasp 37 or similar latch on one side of the slot 35 and tab 38 or other suitable attachment point on the other side of the slot 35, configured to securely hold both sides of the slot 35 together. In embodiments such as illustrated in FIGS. 6B and 6C, the channel fits tightly to the string 2 so as to provide frictional resistance to rotation so the vibration damper/score keeper 30 remains in place during play.

In an alternative embodiment, one or both surfaces of the slot may include an adhesive or other bonding material, such as Velcro™, to hold the two faces together. An adhesive may be included on one or both faces at the time of manufacture, in which case a peel off film or sheet can be provided to prevent the two sides from bonding until the film is removed when the score keeper is positioned on a racquet string. Alternatively, the adhesive may be applied when the score keeper is positioned on a racquet string. Alternatively, Velcro™ may be positioned on the two faces so that the faces are held close together by the Velcro™ action when pressed together.

In an alternative embodiment, the radius of the vibration damper/score keeper 30 is configured to be large enough (i.e., larger than the distance between two adjacent strings) so a portion of the surface of the vibration damper/score keeper 30 touches neighboring strings 2 so as to create friction to prevent unintended rotation during normal play of the game. In an alternative configuration of this embodiment, the surface of the vibration damper/score keeper 30 can include detents or grooves which can engage neighboring strings 2 so as to help prevent rotation whenever a taut neighboring string resides in a detent.

FIG. 6A shows two vibration damper/score keepers 22, one for each side or player. As described above, the two vibration damper/score keepers 30 may be different colors, such as white lettering on a black background on one and black lettering on a white background on the other, to indicate the player or side to which each score applies.

Figure 7:
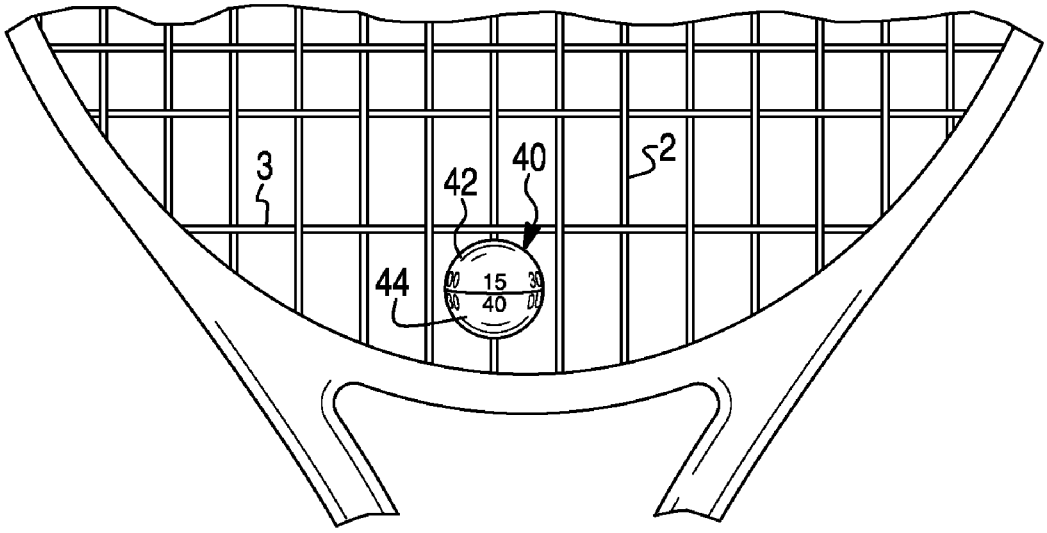
FIG. 7 is a perspective view of another embodiment.

FIG. 7 shows yet another embodiment of the vibration damper/score keeper 40 wherein the assembly includes two indicators 42 and 44 installed adjacently on the same string 2. FIG. 7 shows the two adjacent indicators as two hemispheres 42 and 44 forming a single sphere. Alternatively, the indicators can be two cylinders, two cones, or a combination of shapes. As with the embodiments illustrated in FIG. 6A-6C, each of the separate indicators 42, 44 can include a channel or slot so that a string 2 passes through the center of each the indicators 42, 44. The channel can be a through-hole ("tunnel"), in which case the indicators 42, 44 would be installed when the racquet is strung. Alternatively, the channel can be in the form of a slot so the indicators 42, 44 can be fitted over a string 2, allowing the indicators 42, 44 to be installed without restringing. In an alternative configuration, the channel in the indicators 42, 44 fit tightly to the string 2, such as with the aid of an interlocking joint or clasp as illustrated in FIGS. 6B and 6C, so as to provide frictional resistance to rotation so the indicators 42, 44 remain in place during play. Alternatively, the radius of the indicators 42, 44 can be large enough (i.e., larger than the distance between two adjacent strings) so a portion of the surface of the indicators touch neighboring strings 2 so as to create friction to prevent unintended rotation during normal play of the game. In yet another alternative, the surface of the indicators 42, 44 can include detents or grooves which can engage neighboring strings 2 so as to help prevent rotation whenever a taut neighboring string resides in a detent. As described above, the two indicators 42, 44 may be different colors, such as white lettering on a black background on the top indicator 42 and black lettering on a white background on the bottom indicator 44, to indicate the player or side to which each score applies.

Figure 8:
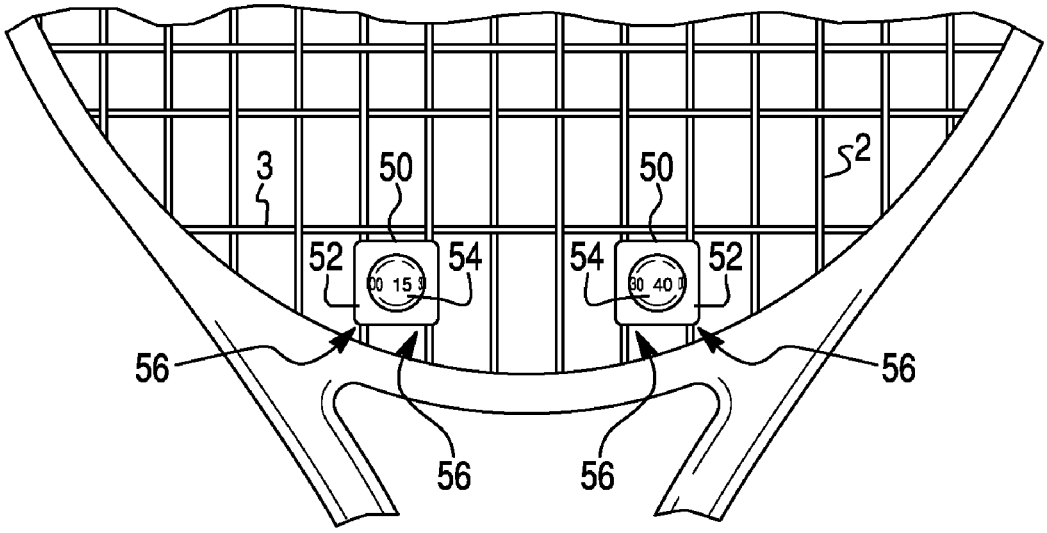
FIG. 8 is a perspective view of another embodiment.

FIG. 8 illustrates yet another embodiment of the vibration damper/score keeper 50, that includes an outer housing or cage 52 which captures at least one score indicator 54 configured to rotate about an axis parallel to the strings 2 or 3. FIG. 8 shows the cage 52 held in place between two strings 2 and holding only one indicator 54. More than one indicator 54 can be included in each cage 52. A side slot 56 can be included on each side of the housing to firmly engage each side string 2. The indicator 54 may be a ball, as illustrated in FIG. 8, or cylinder, frustum of a cone, or other such round shape. The cage 52 may be a unitary device having an inner cavity slightly smaller in diameter than the indicator 54 so that the cage 52 engages the indicator 54 and resists rotational movement, such as by friction. Alternatively, the indicator 54 may have detents, grooves or lands to engage portions of the cage 52 in order to prevent inadvertent rotation. In yet another alternative configuration, a spring-loaded pawl in the cage 52 can be provided so as to engage detents or grooves in the surface of the indicator 54.

Figure 9A:
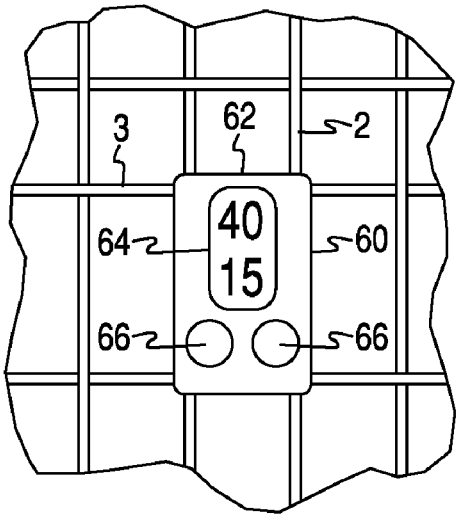
FIGS. 9A and 9B are perspective views of alternative versions of another embodiment.
Figure 9B:
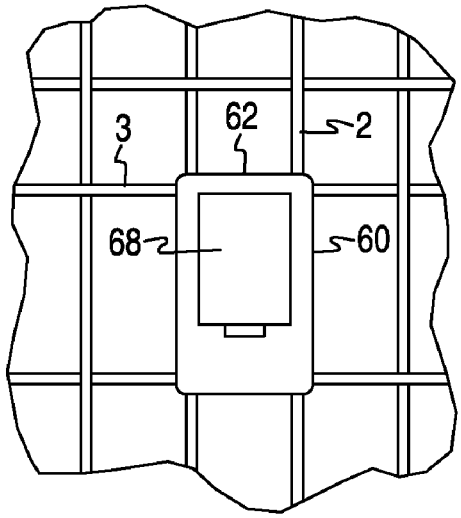

FIGS. 9A and 9B provide detailed views of another embodiment of the vibration damper/score keeper 60 which includes an electronic scoring device. The vibration damper/score keeper 60 comprises a housing 62, which also serves as the dampening mass, in which are positioned electronics (not shown). A display 64, which can be a liquid crystal display (LCD) and at least one button 66 can be positioned within the housing 62. The display 64 is configured to show at least one player's score, but can preferably show two scores, one for each player or side as illustrated in FIG. 9A. Additionally, the display 64 may be configured to also display game and set tallies, depending upon the scoring rules of a particular racquet sport.

As with the mechanical embodiments described herein, the vibration damper/score keeper 60 and display 64 can be configured to present the scores appropriate for the particular game for which the vibration damper/score keeper 60 is intended, such as the scoring sequence shown in the embodiments illustrated in FIGS. 3 and 5. The display 64 can also include an indication of which player or side is associated with each score. For example, the display may label one score as "me" to indicate it applies to the player holding the racquet.

A button 66 is provided for entering each displayed score. In an embodiment, the vibration damper/score keeper 60 can be configured so the player simply presses the button 66 briefly to increment the score, and holds the button 66 down for an extended time (such as two seconds) to reset (zero) the score. Mistakes can be corrected by zeroing the score and repeatedly pressing the button 66 until the correct score is shown. At the end of a game all buttons 66 could be held simultaneously to reset all scores.

In an embodiment suitable for tracking just one score, only a single button 66 is provided. In such an embodiment each player may track their own score or two vibration damper/score keepers 60 may be included on a single racket (such as illustrated in the embodiment shown in FIG. 4).

In an embodiment suitable for tracking two scores, two buttons 66 are provided on the vibration damper/score keeper 60. In such an embodiment, a first button, button A, is used to track the scores of player A, and a second button, button B, is used to track the scores of player B. The vibration damper/score keeper 60 software can keep track of the relationship between the scores of players A and B and adjust the scores as appropriate under the scoring rules of a particular racquet sport. For instance, when both players' scores reach "40" in a tennis embodiment, the vibration damper/score keeper 60 would change both displayed scores to indicate "deuce." Resetting the scores can be accomplished by pressing either button A or button B for an extended period of time (e.g., greater than 2 seconds). Alternatively, button A could reset the score for just player A and an extended pressing of button B could reset the score of just player B. Other configurations of buttons and associated software steps may be implemented in order to provide additional functionality.

In an embodiment suitable for tennis, the vibration damper/score keeper 60 can be configured to count and display the number of games of a set and/or the number of sets in a match won by each player. In this embodiment, the vibration damper/score keeper 60 can automatically increment the game and set tally when the scores are reset at the end of each game. Game and set counts can be reset by pressing the button 66 for a longer interval, such as more than five seconds. To allow for a larger display to show the game and set tallies, the buttons 66 can be located on the back side of the device as illustrated in FIG. 9B. Alternatively, the housing 62 or display 66 can be touch sensitive and thereby act as a button for incrementing and resetting score values.

The vibration damper/score keeper 60 includes electronics for maintaining the count and generating the display images. In an embodiment, the electronics comprise a programmable microcomputer operating a software program to provide the scoring functions described herein, a power supply, and circuitry associated with the button 66 and display 68. The power supply may be an internal battery or a solar cell positioned on the exterior of the vibration damper/score keeper 60 or within the display 64. A solar powered embodiment has the advantages of less weight and a long useful lifetime, and is appropriate to racquet sports which are normally played under conditions of sufficient lighting to allow players to see the ball.

Figure 10:
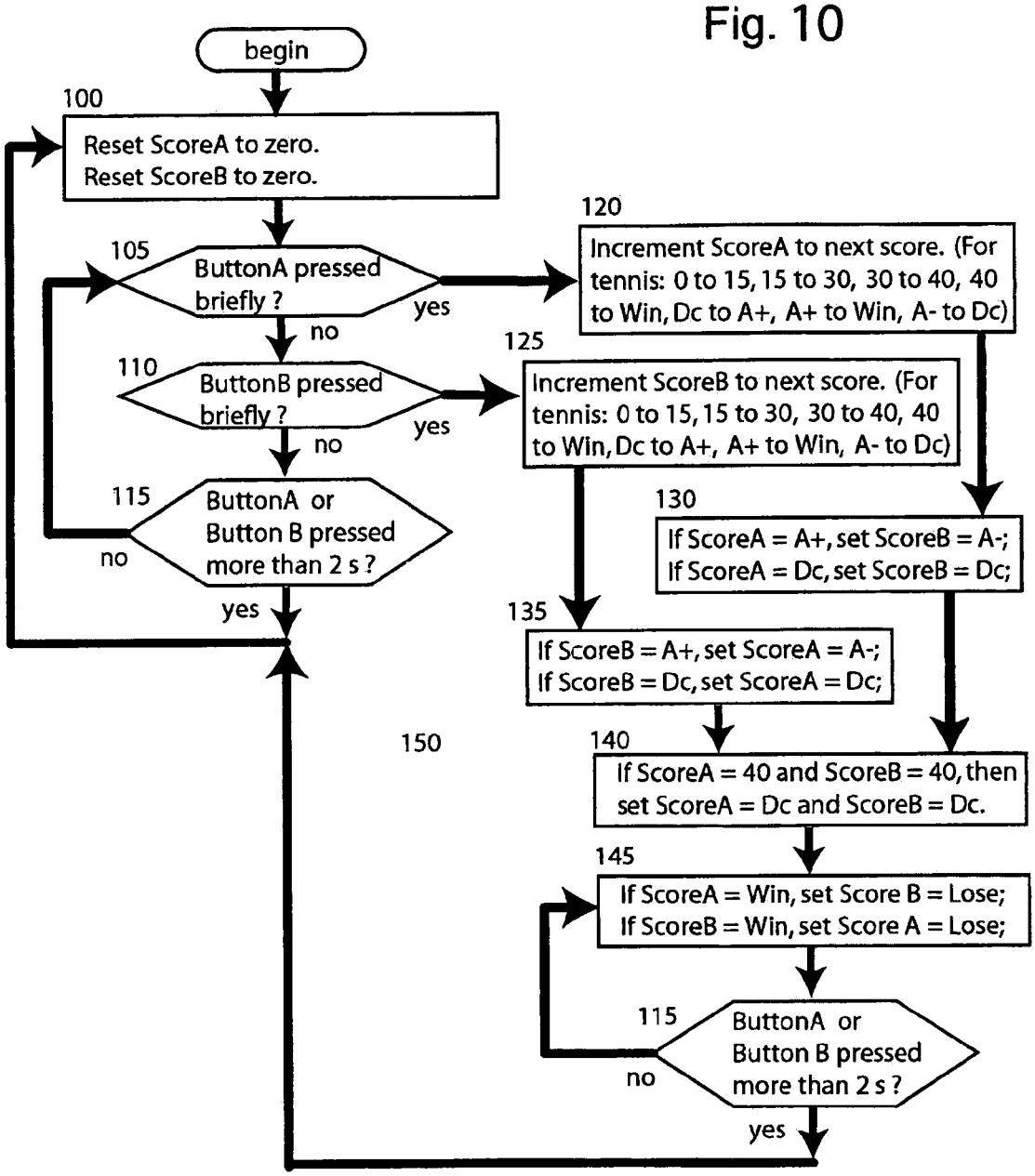
FIGS. 10 and 11 are flow diagrams of example software programs for use in the embodiment shown in FIG. 9A.
Figure 11:
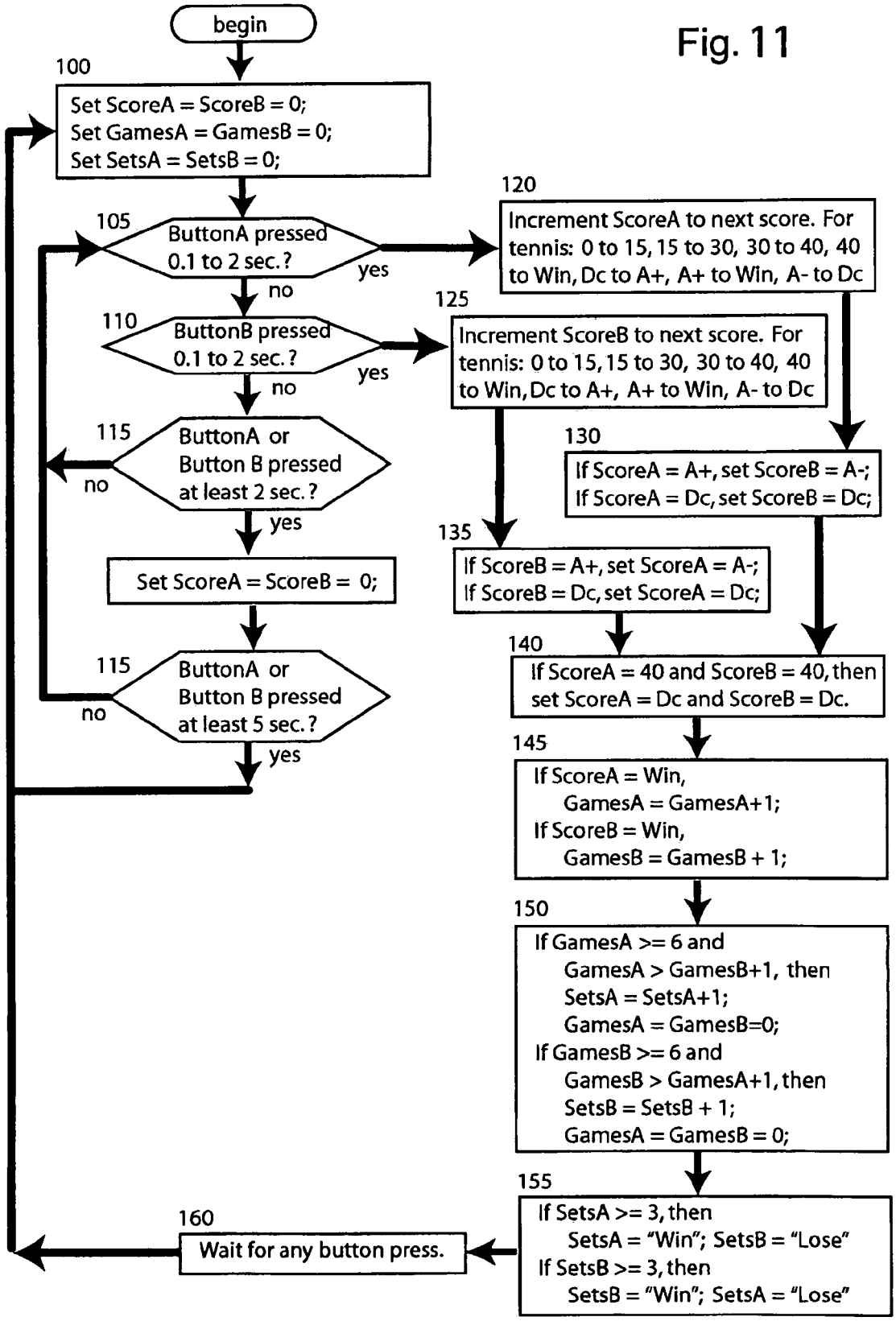

Example embodiments of software programs for operating the vibration damper/score keeper 60 are illustrated in FIGS. 10 and 11. When first turned on, the program would initialize to a score of zero for each player. Subsequently, each press of a button would be interpreted to increment the corresponding player's score to the next appropriate value until a game has been won. Due to the programmable flexibility of a microprocessor, the vibration damper/score keeper 60 embodiment can be more sophisticated than the mechanical embodiments described herein, especially if two players' scores are tallied. For example, when the game score is "deuce," the display may show "D", "Dc", or "=" for each player. Then, after the next point is scored by one player and after the corresponding button 66 is pressed, one score can be "AD" or "A+" for "advantage in", and the other will be "A−". Upon winning, one score can be "WG" and the other "LG", for example. Whenever a button 66 is pressed continuously for at least 2 seconds, the corresponding score (or perhaps both) can be reset.

In an alternative embodiment of the vibration damper/score keeper 60, instead of displaying "WG" at the end of a game, the supplementary game count for the current set can automatically increment and the game scores can reset to zero. When the last game of a set is won, the supplementary set count for the current match can be automatically incremented. If a button is held pressed for at least 5 seconds, all counts can be reset.

Referring to FIG. 10, an example software program begins with initialization of score values in step 100. This may occur when power is turned on or upon holding one or both buttons down for a prolonged period of time. After initialization of scores, the software routine waits until a button is pressed. This may be accomplished in a loop of tests to determine whether a button has been pressed, steps 105, 110, 115. Upon detecting that button A has been pressed, step 105, the program increments and displays the score for player A to the next score in step 120. For an embodiment of a tennis scoring device, the increments would be from 0 to 15, 15 to 30, 30 to 40, 40 to "win" or 30 to "deuce" (e.g., "Dc"), Dc to A+, A+ to win, and A− to Dc. After the scores have been implemented, in step 130, the software determines if the score of the other player should be changed as appropriate under the scoring rules of the particular racquet sport. For example, in tennis to address the scoring progression of deuce-advantage-game, in step 130, if the A player score is advantage ("A+"), the B player's score would be set to A−, and if the A player's score is set to deuce, the B player's score would also be set deuce. Similarly, if the A score is incrementing to 40 and the B score is already 40, then the A and B scores are set to "deuce" in step 145. After a "win" score has been set, the software may wait or test for an extended press of either button A or B (such as more than two seconds) to determine whether the scores should be cleared, step 115. If the score should not be cleared, then the software performs a loop back to step 145 to continue waiting for a reset actuation. If the software determines that either button A or button B has been pressed for the reset duration, then the software jumps to the reset operations of step 100. The software routine associated with pressing button B is similar to that of a button A, implementing steps 125 and 135 to increment scores appropriately. The software may also test the buttons at any time to determine whether either button A or button B has been pressed for more than two seconds indicating a need to reset scores, step 115. The flow process illustrated in FIG. 10 is a summary of software steps that may be implemented in a vibration damper/score keeper, but additional functions may also be included.

FIG. 11 illustrates another example software program that may be implemented on a vibration damper/score keeper in which game and set scores are tracked. As with the routine illustrated in FIG. 10, upon initialization all scores are set to zero, step 100. The routine illustrated in FIG. 11 includes the score tracking steps shown in FIG. 10 for incrementing A's scores in steps 120, 130, and 140 if button A is pressed, and incrementing B's scores in steps 125, 135 and 140 if button B is pressed. FIG. 11 also shows how score values can be used to increment game tallies, and game tallies can be used to increment set tallies. For example, if A's score is incremented to "win," then the game tally for player A would be incremented, step 145. Similarly if B's score is incremented to "win," then the game tally for player B would be incremented. If the game tally for a player exceeds a threshold under the sport's scoring rules, then a set tally maybe incremented in step 150. For example in an embodiment suitable for tennis, if the number of games exceeds six and the game tally for player A is greater than two more than the game tally of player B, then the set tally for player A would be incrementing to "win." Finally, if the set tally exceeds a threshold under the scoring rules for the sport, then the set tally maybe incremented to "win" and the other player's set tally incremented to "lose," step 155, thereby indicating the outcome of the match. After the match score is displayed, the software can wait for a press of buttons indicating that the scores should be reset, step 160. An extended pressing of buttons can indicate whether game scores, game tallies or set tallies should be reset. For example if button A or button B is pressed for more than two seconds but less than five seconds, step 115, then the current game scores should be zeroed, but not the game and set tallies. If button A or button B is pressed for greater than five seconds, step 115, then step 100 is performed to zero all scores and tallies.

In an embodiment, and vibration damper/score keeper 60 may include scoring rules for a number of different racquet sports, and present a player with a menu for selecting the appropriate sport for which scores should be displayed. This can be implemented by changing the incremental scoring rules used in steps 120, 125, 130, 135, and 140. To support this embodiment, the vibration damper/score keeper 60 would include a read-only memory storing the alternative scoring rules for various sports, in addition to the software program.

The various decisions and incrementing operations illustrated in FIGS. 10 and 11 and described for alternative configurations and embodiments may be programmed using software rules or look up tables as is well known in the software arts.

In use, the vibration damper/score keeper 10, 20, 30, 40, 50, or 60 is manipulated by a player to reset the score indicator 16, 22, 32, 44, 52, 54, or 64 to a score of zero by using a finger or fingers to rotate the indicator to the zero position. Whenever one player scores, the indicator 16, 22, 30, 44, 52, 54, or 64 is manually advanced (e.g., by rotation) to the next score. In the case of tennis (and for other games as appropriate) where winning requires two consecutive points by a player (as in tennis's scoring progression of "deuce", "advantage", then "game") the player simply rotates one indicator 16, 22, 30, 44, 52, or 54 back and forth between the indication for "deuce" and "advantage" until the player with the "advantage" wins the next point and thereby wins the game.

While the figures and foregoing embodiments illustrate vibration damper/score keepers for tracking game scores, additional vibration damper/score keepers may be positioned on a racquet and used to also track the number of games or sets won by each player or side in a match. Alternatively, more score indicators may be included on a single vibration damper/score keeper to keep track of game and/or set tallies.

One or more vibration damper/score keepers may be assembled and sold as a kit for use by players, coaches or support personnel to modify their racquets. Such a kit can include one or more vibration damper/score keepers according to various embodiments described herein, instructions for installing the vibration damper/score keepers on the racquet string or strings and, optionally, a tool for holding strings apart to enable inserting the vibration damper/score keeper on the strings and/or adhesive for bonding two faces of the vibration damper/score keepers around racquet strings. Such a kit may be provided in a suitable container. Optionally, the instructions may also include scoring rules of the racquet sport for which the vibration damper/score keeper is intended.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

I claim:

1. A device for a stringed racquet of a racquet sport, comprising:

an impulse dampening mass; and an electronic score tallying indicator coupled to the impulse dampening mass, the electronic score tallying indicator comprising:

a microcomputer;

an electronic display coupled to the microcomputer; and a first button coupled to the microcomputer, wherein the microcomputer is configured with a software program to perform steps comprising:

keeping track of a first game score;

incrementing the first game score in response to a press of the first button; and causing the electronic display to present a representation of the first game score.

2. The device of claim 1, further comprising a second button coupled to the microcomputer, wherein the microcomputer is further configured with the software program to perform steps comprising:

keeping track of a second game score; and incrementing the second game score in response to a press of the second button.

3. The device according to claim 2, wherein the microcomputer is further configured with the software program to perform steps comprising keeping track of game tallies.

4. The device according to claim 2, wherein the first and second buttons are positioned on a side of the device opposite that of the electronic display.

5. The device of claim 1, wherein the microcomputer is further configured with the software program to perform steps comprising resetting the first game score to zero in response to an extended duration press of the first button.

6. The device of claim 1, further comprising a power supply coupled to the microcomputer.

7. The device of claim 6, wherein the power supply comprises a battery.

8. The device of claim 6, wherein the power supply comprises a solar cell.

9. The device according to claim 1, wherein the electronic display is a liquid crystal display.

10. The device according to claim 1, wherein the electronic score tallying indicator is also the impulse dampening mass.

11. The device according to claim 1, further comprising a string attachment channel coupled to the impulse dampening mass.

12. The device according to claim 1, further comprising a string attachment channel formed within the impulse dampening mass.

13. The device according to claim 1, wherein the microcomputer is further configured with the software program to perform steps comprising:

causing the electronic display to present a menu enabling a user to select a particular racquet sport from a plurality of racquet sports; and keeping track of the first game score according to scoring rules of a selected particular racquet sport.

14. The device according to claim 1, further comprising a housing encompassing the microcomputer and electronic display, wherein at least a portion of the housing is touch sensitive and functions as the first button.

15. The device according to claim 1, wherein the electronic display is touch sensitive and the first button is the touch sensitive electronic display.

16. The device according to claim 1, wherein the first button is positioned on a side of the device opposite that of the electronic display.

17. An electronic score keeper for a racquet sport, comprising:

an impulse dampening mass including a string attachment channel configured to attach the impulse dampening mass to racquet strings;

electronics for maintaining a first game score and displaying the first game score;

a housing coupled to the impulse dampening mass and encompassing the electronics; and a first button coupled to the electronics, wherein the electronics are configured to:

keep track of a first game score;

increment the first game score in response to a press of the first button; and display a representation of the first game score.

18. The electronic score keeper of claim 17, further comprising a second button coupled to the electronics, wherein the electronics are further configured to:

keep track of a second game score; and increment the second game score in response to a press of the second button.

19. The electronic score keeper of claim 17, further comprising a battery included within the housing and coupled to the electronics.

20. The electronic score keeper of claim 17, wherein the housing and electronics are also the impulse dampening mass and the string attachment channel is included within the housing.

* * * * *